US012137827B2

(12) United States Patent
Jenkins et al.

(10) Patent No.: US 12,137,827 B2
(45) Date of Patent: Nov. 12, 2024

(54) PACKAGE RECEIVING CONTAINER

(71) Applicants: Michael Jenkins, Memphis, TN (US); Jacqueline Jenkins, Memphis, TN (US)

(72) Inventors: Michael Jenkins, Memphis, TN (US); Jacqueline Jenkins, Memphis, TN (US)

( * ) Notice: Subject to any disclaimer, the term of this patent is extended or adjusted under 35 U.S.C. 154(b) by 30 days.

(21) Appl. No.: 18/080,483

(22) Filed: Dec. 13, 2022

(65) Prior Publication Data

US 2023/0180956 A1 Jun. 15, 2023

Related U.S. Application Data

(60) Provisional application No. 63/288,924, filed on Dec. 13, 2021.

(51) Int. Cl.
*A47G 29/14* (2006.01)
*A47G 29/20* (2006.01)

(52) U.S. Cl.
CPC ..... *A47G 29/141* (2013.01); *A47G 29/20* (2013.01); *A47G 2029/145* (2013.01)

(58) Field of Classification Search
CPC ..... A47G 29/141; A47G 29/20; A47G 29/22; A47G 29/30; A47G 2029/144; A47G 2029/145; A47G 2029/149; B65D 21/086
See application file for complete search history.

(56) References Cited

U.S. PATENT DOCUMENTS

| | | | | |
|---|---|---|---|---|
| 1,579,520 | A * | 4/1926 | Fleming | A47G 29/12 232/19 |
| 1,992,640 | A * | 2/1935 | Steen | A47G 29/1209 232/17 |
| 2,781,964 | A * | 2/1957 | Ledgerwood | A47G 29/121 232/17 |
| 5,878,903 | A * | 3/1999 | Ung | B65D 90/587 220/666 |
| 7,256,691 | B2 * | 8/2007 | Awobue | A47G 29/1214 340/569 |
| 9,211,025 | B1 * | 12/2015 | Elhawwashy | A47G 29/20 |
| 10,039,401 | B1 * | 8/2018 | Romanucci | A47G 29/141 |
| 10,299,617 | B1 * | 5/2019 | Castellanos | A47G 29/141 |
| 10,743,693 | B2 * | 8/2020 | Newcomb | E06B 7/32 |
| 10,772,451 | B2 * | 9/2020 | Vernal Silva | A47G 29/20 |
| 11,109,705 | B2 * | 9/2021 | Raphael | A47G 29/141 |
| 11,172,777 | B1 * | 11/2021 | Ausland | A47G 29/141 |
| 11,492,172 | B1 * | 11/2022 | Izquierdo | A47G 29/141 |
| 11,877,681 | B2 * | 1/2024 | Willhoit | A47L 23/26 |

(Continued)

*Primary Examiner* — William L Miller
(74) *Attorney, Agent, or Firm* — The Iwashko Law Firm, PLLC; Lev Ivan Gabriel Iwashko

(57) ABSTRACT

A package receiving container, including a main body to store at least one item therein, a lid assembly movably disposed on at least a portion of the main body to prevent access within the main body while closed and facilitate access within the main body while opened, a lock disposed on at least a portion of the lid assembly to prevent the lid assembly from opening in response to being locked; and a control unit disposed within at least a portion of the main body to monitor for receipt of the at least one item within the main body and sending a signal to an external device that the at least one item has been delivered in response to the main body receiving the at least one item.

8 Claims, 1 Drawing Sheet

(56) References Cited

U.S. PATENT DOCUMENTS

| | | | | |
|---|---|---|---|---|
| 2013/0098980 | A1* | 4/2013 | Supulski | A47G 29/121<br>232/38 |
| 2016/0331171 | A1* | 11/2016 | Jiang | A47G 29/141 |
| 2017/0286905 | A1* | 10/2017 | Richardson | G06Q 10/0836 |
| 2018/0070753 | A1* | 3/2018 | Eveloff | H04W 4/025 |
| 2018/0228310 | A1* | 8/2018 | Enobakhare | A47G 29/20 |
| 2018/0228311 | A1* | 8/2018 | Bloom | A47G 29/20 |
| 2019/0038062 | A1* | 2/2019 | Sundaresan | A47G 29/124 |
| 2019/0180544 | A1* | 6/2019 | Newcomb | E06B 7/32 |
| 2019/0239673 | A1* | 8/2019 | Silva | A47G 29/141 |
| 2019/0261802 | A1* | 8/2019 | Vernal | A47G 29/20 |
| 2019/0362577 | A1* | 11/2019 | Vigil | G07C 9/27 |
| 2020/0035051 | A1* | 1/2020 | Kane | G07C 9/00912 |
| 2021/0015286 | A1* | 1/2021 | McCloskey, III | A47G 29/22 |
| 2021/0045563 | A1* | 2/2021 | Bartley-Clark | A47G 29/141 |
| 2021/0196071 | A1* | 7/2021 | Gecho | A47G 29/30 |
| 2021/0298507 | A1* | 9/2021 | Grijalva | A47G 29/20 |
| 2022/0031105 | A1* | 2/2022 | Newcomb | G06K 7/10366 |
| 2022/0114853 | A1* | 4/2022 | Emde | F25D 29/006 |
| 2022/0248888 | A1* | 8/2022 | Willhoit | A47L 23/26 |
| 2022/0338658 | A1* | 10/2022 | Soderberg | A47G 29/141 |

* cited by examiner

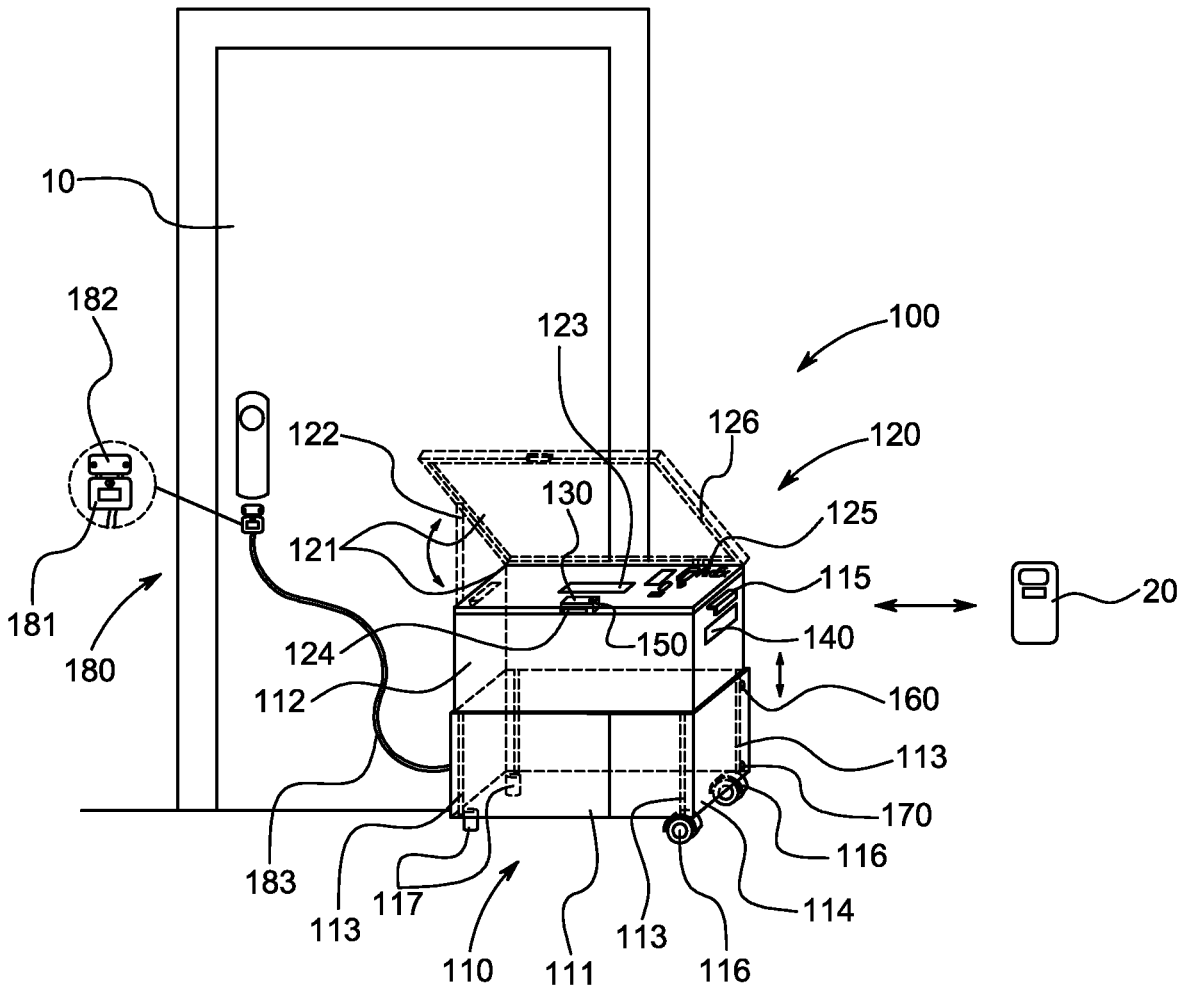
10
182
123
100
122
126
120
130
125
121
115
20
181
150
140
124
180
112
160
113
170
116
183
117
114
113
113
110
111
116

PACKAGE RECEIVING CONTAINER

CROSS-REFERENCE TO RELATED APPLICATIONS

This application claims priority under 35 USC § 120 from U.S. Provisional Application No. 63/288,924, entitled "Package Receiving Container," which was filed on Dec. 13, 2021, in the United States Patent and Trademark Office, the disclosure of which is incorporated herein in its entirety by reference.

BACKGROUND

1. Field

The present general inventive concept relates generally to a container, and particularly, to a package receiving container.

2. Description of the Related Art

Package theft and/or damage is a growing inconvenience for many consumers. Packages that are left on a porch and/or a doorstep are an easy target for a thief. As such, the packages are highly likely to be stolen and/or tampered with while left unattended on the porch and/or the doorstep.

Moreover, mailboxes for houses are easily opened and accessed. Thus, even in the event the packages are inserted into the mailbox, the mailbox is prone to theft.

Therefore, there is a need for other a package receiving container that conceals and/or prevents access to the package while the package is contained within. Also, there is a need for the package receiving container to alert a user of arrival of the package.

SUMMARY

The present general inventive concept provides a package receiving container.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a package receiving container, including a main body to store at least one item therein, a lid assembly movably disposed on at least a portion of the main body to prevent access within the main body while closed and facilitate access within the main body while opened, a lock disposed on at least a portion of the lid assembly to prevent the lid assembly from opening in response to being locked; and a control unit disposed within at least a portion of the main body to monitor for receipt of the at least one item within the main body and sending a signal to an external device that the at least one item has been delivered in response to the main body receiving the at least one item.

The main body may include a base section to store the at least one item therein, and a top section movably disposed within at least a portion of the base section to move from disposed within the base section to at least partially extended away from the base section in a first direction, and move from extended away from the base section to disposed within the base section in a second direction, such that the top section increases a volume of storage space while the top section is extended away from the base section.

The main body may further include a plurality of tracks disposed on each corner edge of the base section to facilitate movement of the top section within the base section.

The base section and the top section may be constructed of aromatic polyamide to increase resistance to ballistics.

The lid assembly may include a lid body, a folding bracket connected at a first end to at least a portion of the lid body and at a second end to at least a portion of the main body to prevent the lid body from closing while the folding bracket is fully extended, and an envelope receiving aperture disposed on at least a portion of the lid body to receive the at least one item therethrough.

The lid assembly may further include an insulation layer disposed on at least a portion of a perimeter of the lid body to absorb an impact of the lid body against the main body in response to closing the lid body against the main body.

The control unit may transmit a randomly generated combination of the lock to an authorized courier in response to the control unit detecting a presence of the authorized courier.

The control unit may prevent transmission of the randomly generated combination of the lock in response to the control unit detecting a presence of at least one unauthorized user.

The package receiving container may further include a remote unit removably connected to at least a portion of a door to remotely control locking functions of the lock.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a side perspective view of a package receiving container, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Package Receiving Container 100
Main Body 110
Base Section 111
Top Section 112
Tracks 113
Base 114
Handle 115
Wheels 116
Pegs 117
Lid Assembly 120
Lid Body 121
Folding Bracket 122
Envelope Receiving Aperture 123
Recessed Surface 124
Hinges 125
Insulation Layer 126
Lock 130
Control Unit 140
Power Source 150
Size Adjustment Button 160
Locking Button 170
Remote Unit 180
Remote Lock 181
Secure Plate 182
Connecting Cord 183

FIG. 1 illustrates a side perspective view of a package receiving container 100, according to an exemplary embodiment of the present general inventive concept.

The package receiving container 100 may be constructed from at least one of metal, plastic, wood, glass, and rubber, etc., but is not limited thereto.

The package receiving container 100 may include a main body 110, a lid assembly 120, a lock 130, a control unit 140, a power source 150, a size adjustment button 160, a locking button 170, and a remote unit 180, but is not limited thereto.

Referring to FIG. 1, the main body 110 is illustrated to have a rectangular prism shape. However, the main body 110 may be rectangular, circular, cylindrical, triangular, pentagonal, hexagonal, heptagonal, octagonal, or any other shape known to one of ordinary skill in the art, but is not limited thereto.

The main body 110 may include a base section 111, a top section 112, a plurality of tracks 113, a base 114, a handle 115, a plurality of wheels 116, and a plurality of pegs 117, but is not limited thereto.

The base section 111 may have a predetermined size. For example, the base section 111 may have a length of forty-eight inches, a width of twenty inches, and a height of twenty-four inches. The base section 111 may store at least one item therein, such as a parcel, a package, a box, an envelope, and/or any combination thereof, but is not limited thereto. The base section 111 may be disposed on a porch and/or near a door 10.

The top section 112 may be movably (i.e., slidably) disposed within at least a portion of the base section 111. More specifically, the top section 112 may move from disposed within the base section 111 to at least partially extended away from the base section 111 in a first direction. Conversely, the top section 112 may move from extended away from the base section 111 to disposed within the base section 111 in a second direction opposite with respect to the first direction. As such, the top section 112 may be stored within the base section 111 and/or extended away from the base section 111 to increase a volume of storage space therein.

The plurality of tracks 113 may be disposed within at least a portion of the base section 111. More specifically, at least one of the plurality of tracks 113 may be disposed on each corner edge within the base section 111. As such, the plurality of tracks 113 may facilitate movement of the top section 112 within the base section 111 along each of the plurality of tracks 113.

The base 114 may receive the at least one item thereupon. Moreover, the base 114 may include a vinyl layer to prevent damage from at least one liquid thereon. In other words, the base 114 may be liquid proof.

The handle 115 may be disposed on at least a portion of an outer surface of the top section 112. The handle 115 may facilitate gripping thereof.

The plurality of wheels 116 may be movably (i.e., rotatably) disposed on at least a portion of a first end of the base 114. The plurality of wheels 116 may support the base section 111 and/or the top section 112 thereupon. The base section 111 and/or the top section 112 may move in response to rotation of at least one of the plurality of wheels 116. Moreover, the base section 111 and/or the top section 112 may move in response to an application of force (e.g., pushing, pulling) thereto. For example, the base section 111 and/or the top section 112 may move in response to pulling the handle 115 in at least one direction.

The plurality of pegs 117 may be disposed on at least a portion of a second end of the base 114 opposite with respect to the first end. Additionally, the plurality of pegs 117 may prevent resist and/or prevent movement of the base section 111 and/or the top section 112 while the plurality of pegs 117 contact a surface, such as a ground surface. During use, the plurality of pegs 117 may keep the main body 110 from moving, while at least partially elevating the second end of the base section 111 and/or the top section 112 may facilitate movement using the plurality of wheels 116.

The lid assembly 120 may include a lid body 121, a folding bracket 122, an envelope receiving aperture 123, a recessed surface 124, a plurality of hinges 125, and an insulation layer 126, but is not limited thereto.

The lid body 121 may be movably (i.e., pivotally, rotatably) disposed on at least a portion of the top section 112. The lid body 121 may move from closed over the top section 112 in a first position to at least partially opened away from the top section 112 in a second position. Conversely, the lid body 121 may move from opened away from the top section 112 in the second position to closed over the top section 112 in the first position. Accordingly, the lid body 121 may prevent access within the top section 112 while closed and facilitate access within the top section 112 while opened.

The base section 111, the top section 112, and/or the lid body 121 may be constructed of aromatic polyamide (a.k.a., aramid) and/or other synthetic fibers that are resistant to heat and/or resistance to ballistics.

The folding bracket 122 may be connected to at least a portion of the lid body 121 and/or the top section 112. Moreover, the folding bracket 122 may fold at a center portion thereof via a joint in response to closing the lid body 121 over the top section 112, and at least partially extend in response to opening the lid body 121 away from the top section 112. It is important to note that the folding bracket 122 may be rigid while extended, such that the folding bracket 122 may prevent the lid body 121 from closing while fully extended. However, the folding bracket 122 may receive an application of force (e.g., pushing, pulling) at the center portion to cause the folding bracket 122 to fold at the joint.

The envelope receiving aperture 123 may be disposed on at least a portion of a center of the lid body 121. The envelope receiving aperture 123 may receive the at least one item therethrough. For example, the envelope receiving aperture 123 may receive a mail envelope therethrough.

The recessed surface 124 may be disposed on at least a portion of a bottom surface of the lid body 121. The recessed surface 124 may be recessed with respect to an entirety of the bottom surface of the lid body 121. The recessed surface 124 may facilitate gripping of the lid body 121.

The plurality of hinges 125 may be disposed on at least a portion of the lid body 121 and/or the top section 112. The plurality of hinges 125 may facilitate movement of the lid 121 with respect to the top section 112.

The insulation layer 126 may be constructed of a cushion and rubber, but is not limited thereto.

The insulation layer 126 may be disposed on at least a portion of a perimeter of the lid body 121. In other words, the insulation layer 126 may be disposed on each edge of the lid body 121. The insulation layer 126 may absorb an impact of the lid body 121 against the top section 112. As such, the insulation layer 126 may prevent damage to the lid body 121 in response to closing the lid body 121 against the top section 112. Furthermore, the insulation layer 126 may create an airtight and water tight seal between the lid body 121 and/or the top section 112 while the lid body 121 is closed.

The lock 130 may include a combination lock, an electronic lock, a key lock, and/or any combination thereof, but is not limited thereto.

The lock 130 may be disposed on at least a portion of the lid body 121. The lock 130 may automatically lock the lid body 121 to the top section 112 in response to closing the lid body 121. As such, the lock 130 may prevent the lid body 121 from opening. However, the lock 130 may unlock in response to receiving a correct combination and/or a correct key therein.

However, an owner of the main body 110 may easily access an interior thereof and bypass the lock 130, through a rear panel of the main body 110, such as using a separate key.

The control unit 140 may include a sensor, a processing unit, and a communication unit, but is not limited thereto.

The sensor of the control unit 140 may include a movement sensor and a weight sensor, but is not limited thereto.

The processing unit of the control unit 140 (or central processing unit, CPU) may include electronic circuitry to carry out instructions of a computer program by performing basic arithmetic, logical, control and input/output (I/O) operations specified by the instructions. The processing unit of the control unit 140 may include an arithmetic logic unit (ALU) that performs arithmetic and logic operations, processor registers that supply operands to the ALU and store the results of ALU operations, and a control unit that fetches instructions from memory and "executes" them by directing the coordinated operations of the ALU, registers and other components. The processing unit of the control unit 140 may also include a microprocessor and a microcontroller.

The communication unit of the control unit 140 may include a device capable of wireless or wired communication between other wireless or wired devices via at least one of Wi-Fi, Wi-Fi Direct, infrared (IR) wireless communication, satellite communication, broadcast radio communication, Microwave radio communication, Bluetooth, Bluetooth Low Energy (BLE), Zigbee, near field communication (NFC), and radio frequency (RF) communication, USB, global positioning system (GPS), Firewire, and Ethernet.

The processing unit of the control unit 140 may have a program and/or a software application running thereon to monitor receipt of the at least one item within the base section 111 and/or the top section 112. Moreover, the sensor of the control unit 140 may detect deposit of the at least one item within the base section 111 and/or the top section 112. The communication unit of the control unit 140 may send a signal to an external device 20 (e.g., mobile device, cell phone, tablet computer, desktop computer, laptop computer personal digital assistant (PDA), etc.) in response to the base section 111 and/or the top section 112 receiving the at least one item. As such, the external device 20 may receive notification that a package has been delivered.

During use, a combination of the lock 130 may be provided to a courier (e.g., a postal service, a parcel delivery service) by a user. Thereafter, the courier may input the combination to the lock 130 to open the lid body 121. Subsequently, the control unit 140 may determine the package has been delivered in response to detecting the at least one item has been disposed within the base section 111 and/or the top section 112, and the lid body 121 has been closed. The lock 130 may automatically lock after the at least one item has been disposed within the base section 111 and/or the top section 112.

Alternatively, the lock 130 may randomly generate the combination. Thereafter, the communication unit of the control unit 140 may detect a presence of an authorized courier, such that the communication unit of the control unit 140 may transmit the combination to the courier upon the courier being within a predetermined proximity (e.g., five feet, ten feet) of the control unit 140. However, the communication unit of the control unit 140 may monitor for presence of additional people, such that the communication unit of the control unit 140 may prevent transmission of the combination while at least one unauthorized user remains within the predetermined proximity.

The power source 150 may include a battery, a power inlet, and a solar cell, but is not limited thereto.

The power source 150 may be disposed within at least a portion of the lid body 121, the base section 111, and/or the top section 112. The power source 150 may provide power to the lock 130 and/or the control unit 140.

The size adjustment button 160 may be disposed on at least a portion of the base section 111. The size adjustment button 160 may be connected to a motor within the base section 111. The top section 112 may move from disposed within the base section 111 to at least partially extended away from the base section 111 in response to depressing the size adjustment button 160 a first time. Conversely, the top section 112 may move from extended away from the base section 111 to disposed within the base section 111 in response to depressing the size adjustment button 160 a second time different from the first time. As such, the top section 112 may move in response to rotation of the motor. As such, the power source 150 may also provide power to the size adjustment button 160 and/or the motor.

The locking button 170 may be disposed on at least a portion of the base section 112. The locking button 170 may prevent the top section 112 from moving in response to being depressed a first time. However, the locking button 170 may release the top section 112, such that the top section 112 may move in response to depressing the locking button 170 a second time different from the first time.

The remote unit 180 may include a remote lock 181, a secure plate 182, and a connecting cord 183, but is not limited thereto.

The remote lock 181 may be removably connected to at least a portion of the door 10. The remote lock 181 may perform all similar functions of the lock 130 as described above.

The secure plate 182 may be disposed on at least a portion of the remote lock 181 and/or removably connected to at least a portion of the door 10. The secure plate 182 may prevent the remote lock 181 from being removed from the door 10 absent use of tools and/or a key.

The connecting cord 183 may be connected at a first end to at least a portion of the remote lock 181 and/or connected at a second end to the base section 111. The connecting cord 183 may connect the remote lock 181 to the base section 111. The remote lock 181 may emit an alarm sound and/or notify the external device 20 with an alarm signal in response to tampering and/or attempted tampering of the lock 130 and/or the remote lock 181.

Therefore, the package receiving container 100 may conceal and/or prevent access to the at least one item stored therein. Additionally, the package receiving container 100 may alert the user as to receipt of the at least one item.

The present general inventive concept may include a package receiving container 100, including a main body 110 to store at least one item therein, a lid assembly 120 movably disposed on at least a portion of the main body 110 to prevent access within the main body 110 while closed and facilitate access within the main body 110 while opened, a lock 130 disposed on at least a portion of the lid assembly 120 to prevent the lid assembly 120 from opening in response to being locked; and a control unit 140 disposed within at least a portion of the main body 110 to monitor for receipt of the at least one item within the main body 110 and sending a signal to an external device 20 that the at least one item has been delivered in response to the main body 110 receiving the at least one item.

The main body 110 may include a base section 111 to store the at least one item therein, and a top section 112 movably disposed within at least a portion of the base section 111 to move from disposed within the base section 111 to at least partially extended away from the base section 111 in a first direction, and move from extended away from the base section 111 to disposed within the base section 111 in a second direction, such that the top section 112 increases a volume of storage space while the top section 112 is extended away from the base section 111.

The main body 110 may further include a plurality of tracks 113 disposed on each corner edge of the base section 111 to facilitate movement of the top section 112 within the base section 111.

The base section 111 and the top section 112 may be constructed of aromatic polyamide to increase resistance to ballistics.

The lid assembly 120 may include a lid body 121, a folding bracket 122 connected at a first end to at least a portion of the lid body 121 and at a second end to at least a portion of the main body 110 to prevent the lid body 121 from closing while the folding bracket 122 is fully extended, and an envelope receiving aperture 123 disposed on at least a portion of the lid body 121 to receive the at least one item therethrough.

The lid assembly 120 may further include an insulation layer 126 disposed on at least a portion of a perimeter of the lid body 121 to absorb an impact of the lid body 121 against the main body 110 in response to closing the lid body 121 against the main body 110.

The control unit 140 may transmit a randomly generated combination of the lock 130 to an authorized courier in response to the control unit 140 detecting a presence of the authorized courier.

The control unit 140 may prevent transmission of the randomly generated combination of the lock 130 in response to the control unit 140 detecting a presence of at least one unauthorized user.

The package receiving container 100 may further include a remote unit 180 removably connected to at least a portion of a door 10 to remotely control locking functions of the lock 130.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A package receiving container, comprising:

a main body to store at least one item therein;

a lid assembly movably disposed on at least a portion of the main body to prevent access within the main body while closed and facilitate access within the main body while opened;

a lock disposed on at least a portion of the lid assembly to prevent the lid assembly from opening in response to being locked; and a control unit disposed within at least a portion of the main body to monitor for receipt of the at least one item within the main body and sending a signal to an external device that the at least one item has been delivered in response to the main body receiving the at least one item, wherein the main body comprises:

a base section to store the at least one item therein, and a top section movably disposed within at least a portion of the base section to move from disposed within the base section to at least partially extended away from the base section in a first direction, and move from extended away from the base section to disposed within the base section in a second direction, such that the top section increases a volume of storage space while the top section is extended away from the base section.

2. The package receiving container of claim 1, wherein the main body further comprises:

a plurality of tracks disposed on each corner edge of the base section to facilitate movement of the top section within the base section.

3. The package receiving container of claim 1, wherein the base section and the top section are constructed of aromatic polyamide to increase resistance to ballistics.

4. The package receiving container of claim 1, wherein the lid assembly comprises:

a lid body;

a folding bracket connected at a first end to at least a portion of the lid body and at a second end to at least a portion of the main body to prevent the lid body from closing while the folding bracket is fully extended; and an envelope receiving aperture disposed on at least a portion of the lid body to receive the at least one item therethrough.

5. The package receiving container of claim 4, wherein the lid assembly further comprises:

an insulation layer disposed on at least a portion of a perimeter of the lid body to absorb an impact of the lid body against the main body in response to closing the lid body against the main body.

6. The package receiving container of claim 1, wherein the control unit transmits a randomly generated combination of the lock to an authorized courier in response to the control unit detecting a presence of the authorized courier.

7. The package receiving container of claim 6, wherein the control unit prevents transmission of the randomly generated combination of the lock in response to the control unit detecting a presence of at least one unauthorized user.

8. A package receiving container, comprising:

a main body to store at least one item therein;

a lid assembly movably disposed on at least a portion of the main body to prevent access within the main body while closed and facilitate access within the main body while opened;

a lock disposed on at least a portion of the lid assembly to prevent the lid assembly from opening in response to being locked;

a control unit disposed within at least a portion of the main body to monitor for receipt of the at least one item within the main body and sending a signal to an external device that the at least one item has been delivered in response to the main body receiving the at least one item; and a remote unit removably connected to at least a portion of a door to remotely control locking functions of the lock.

* * * * *